US010021921B2

(12) United States Patent
James

(10) Patent No.: US 10,021,921 B2
(45) Date of Patent: Jul. 17, 2018

(54) JEANS GARMENT HAVING BODY CONTOURING AND SHAPE-ENHANCING FUNCTIONS

(71) Applicant: Winfield Gilbert James, Ellenwood, GA (US)

(72) Inventor: Winfield Gilbert James, Ellenwood, GA (US)

( * ) Notice: Subject to any disclaimer, the term of this patent is extended or adjusted under 35 U.S.C. 154(b) by 399 days.

(21) Appl. No.: 14/106,726

(22) Filed: Dec. 14, 2013

(65) Prior Publication Data

US 2015/0164151 A1 Jun. 18, 2015

(51) Int. Cl.
*A41D 1/06* (2006.01)

(52) U.S. Cl.
CPC ..... *A41D 1/06* (2013.01); *A41D 2400/38* (2013.01)

(58) Field of Classification Search
CPC ... A41D 1/06; A41D 1/00; A41D 1/08; A41D 13/00
USPC ..... 2/227
See application file for complete search history.

(56) References Cited

U.S. PATENT DOCUMENTS 4,894,867 A * 1/1990 Ceravolo ..... A41D 1/08 2/227
4,987,613 A * 1/1991 Loverdi ..... A41D 1/08 2/22
5,103,505 A * 4/1992 Llorens ..... A41D 13/0537 2/228
5,649,328 A * 7/1997 Martin ..... A41D 1/08 2/227
5,888,118 A * 3/1999 Kishi ..... A41C 1/003 2/243.1
6,874,168 B1 * 4/2005 Kuhuski ..... A41D 27/26 2/227
7,832,022 B1 * 11/2010 Peters ..... A41D 1/08 2/227
8,561,214 B2 * 10/2013 Turner ..... A41D 13/0156 2/227
2005/0246819 A1 * 11/2005 Tucker ..... A41F 9/00 2/227
2009/0031469 A1 * 2/2009 Christensen ..... A41D 1/06 2/69

* cited by examiner

*Primary Examiner* — Gloria Hale

(57) ABSTRACT

The invention discloses contoured, shape-enhancing jeans garments having permanent inner structures of a buttocks enhancing contoured form at the posterior waistband portion and torso region; and, an anterior tummy slimming and smoothing pocket structure system, eliminating the need for additional or separate buttocks expanding, or shaping devise, or girdle type undergarments. The buttocks system is affixed at strategic points to the posterior of the jeans garment; and the tummy system is similarly incorporated at the anterior of the garments. The buttocks system is comprised of a tapered open cell foam pad with a stretchable posterior casing and anterior minimal stretch lining allowing for flexibility, comfort and conformity to the individuals physique with a free floating lower edge. The tummy system is specifically positioned to slim and smooth by covering and containing the tummy of the wearer.

12 Claims, 7 Drawing Sheets

JEANS GARMENT HAVING BODY CONTOURING AND SHAPE-ENHANCING FUNCTIONS

1. FIELD OF THE INVENTION

The present invention was originally submitted to the USPTO under the provisional patent application No. 61/745,544 and is generally directed to a garment capable of contouring and enhancing the shape of the body of the wearer. More particularly, aspects of the present invention relate to a jeans garment with a utility purpose of providing contoured buttocks enhancement and tummy slimming control effects on the lower-body profile of the wearer of the pants garment and, ultimately, capable of providing the wearer of this garment with a more aesthetically appealing physique.

2. BACKGROUND OF THE INVENTION

The desire to attain a perfect physique, in particular a more shapely and prominent buttocks is heightened by the constant barrage of such images by mass media marketing in the fashion, beauty and cosmetic surgery industries. Approaching the quest for the appearance of a perfect physique, individuals engage in stringent diet and exercise routines. Many persons, predominantly women, consider and regularly resort to the option of cosmetic surgery in order to achieve this end, and often times at great financial costs and at significant medical risks. These procedures many times fail and lack the desired results.

The fashion and apparel industries in attempts to fill the void, circumventing the need for surgery or other drastic methods, produced a variety of garments claiming to slim the tummy area and lift or exaggerate the buttocks, and provide overall improvement of the wearer's outward appearance.

The process to improve the appearance of the lower half of the female body began with the invention of the girdle. The girdle, however, is primarily constructed from materials which confine, constrain and restrict the wearer, inhibiting movement and causing great discomfort.

Recently a variety of insertable pads, garments to accept the pads, padded undergarments, garments with built in girdles and foundations; marketed and directed towards improving the shape and visually enhancing the buttocks and hips, as well as flattening the abdomen of the wearer, have proliferated the market. These garments, most in the form of undergarments provide the wearer with an unnatural appearance and by their very nature, bind, confine and restrict the wearer. The garments do little more than attempt to constrain, redistribute and reposition the wearer's underlying hips, buttocks, tummy and surrounding superfluous fat. Moreover, garments made from stretchable materials, particularly garments with built in girdles and foundations, and garments constructed from a combination thereof, squeeze, truss and thrust the buttocks and hips into conformity, and constrict the abdomen.

These garments are inadequate. When the abdomen of the wearer is constricted, it provides the wearer with a most uncomfortable feeling and often protrudes upwards creating a "muffin-top" effect.

Further, in instances where separate undergarments are worn under exterior clothing for shape enhancement, consisting of currently available padded panties, and undergarments with pockets for inserting two separate pads, the wearer experiences the uni-butt phenomenon; or uneven shifting and sagging with movement and usage, is readily visible through the outer wear. The end result is an unnatural and unattractive appearance that is uncomfortable and cumbersome to the wearer at best.

SUMMARY OF THE INVENTION

It is therefore an object of the present invention to provide a jeans garment which naturalistically conforms to, and functions in concert with the wearer's lower torso region, and which include integrally sewn inner structures that contour, shape and aesthetically enhance the wearer's physique without creating any discomfort.

Another object of the present invention is to provide a singular garment which contours and accentuates the hips and buttocks of the wearer in a natural manner; and, smoothes and slims the tummy of the wearer in a non-binding manner. To achieve such, another aspect of the present invention providing a formed, contoured and tapered open cell foam pad with a posterior casing, so as to conform to the wearer's buttocks, is incorporated therein to the interior rear portion of the jeans garment; and, a pocket system comprised of enlarged pockets formed from low to non-stretchable materials is incorporated therein to the interior front portions of the jeans garment.

Yet another object of the present invention is to provide the wearer with a natural posterior appearance by subtly transforming, expanding and shaping the wearer's buttocks. This aspect of the present invention is provided through the outwardly convex and inwardly concave structured open cell foam pad, which is contoured and tapered so as to expand and shape the natural buttocks of the wearer, whereas such tapering extends from the highpoint of said pad located at the posterior center of each simulated buttocks hemispheres, to a single layer laterally stretchable casing at all outer margins of said pad.

Yet another object of the present invention is to provide for a natural appearance of the posterior of the wearer and eliminate the uni-butt phenomenon, or similar unnatural presentations, while representing the natural separation of both hemispheres of the right and left buttocks cheeks when incorporated therein. This aspect of the present invention is achieved through the individually simulated right and left buttocks hemispheres of the pad which begins at an approximate point of the standard region on the pad that corresponds to the point on the wearer's buttocks where the right and left buttocks cheeks naturally emanate, namely the beginning "crack" of the buttocks; and is tapered from that highpoint of the center of each simulated cheek and continuing to the single layer, laterally stretchable diamond shaped center which extends from the above described point and continues downward and outward towards the bottom of both sides of the pad.

Yet another object of the present invention is to provide for the undetectable presence of the inner structure of the jeans garment when viewed as worn by the wearer. This aspect of the present invention is achieved through the binding of the contoured, convex and concave shaped, tapered and affixed to the laterally stretchable posterior casing as previously described open cell foam pad to a posterior casing comprising of a laterally stretchable material to the diamond shaped design and a single layer at all margins as to create an invisible transition from the pad to the said casing. As such, the shape enhancing system is also undetectable to the wearer in terms of the feel when the garment is being worn.

Therefore, another object of the present invention is to provide comfort, easy wearability and freedom of movement while maintaining conformance to the wearer's natural profile. Specifically, this is achieved through the creation of the single layered, expandable and retractable diamond shaped segment emanating from the partial separation point of the pad that simulates the individual right and left cheeks of the buttocks, and extending downward and outward towards the bottom of the open cell foam pad. Further, another object of this aspect of the invention is achieved when the said pad is fully integrated into the outer garment through an outer lining which when coupled together, the pad and outer lining have a lower edge that are not attached or affixed to the outer garment, but rather creates a free floating system which permits conformance while still providing freedom of utility, hence comfort and wearability.

Still another aspect of the present invention is to provide a singular garment which contours and accentuates the hips and buttocks of the wearer in a natural manner without unsightly and uneven shifting and sagging when it is in use by the wearer. This is achieved through securing the said contoured pad and outer anterior rear lining to the posterior rear panels of the outer garment at the appropriate points, during the manufacturing process, to the waist, side and crotch portions of the garment.

Still another object of the present invention relates to the slimming and smoothing of the tummy of the wearer in a non-binding, non-constricting and in a comfortable manner, while eliminating the dreaded muffin-top outcome. This aspect of the present invention is achieved by an oversized, intentionally slanted pocket system made from minimal stretch fabric and appropriately integrated to the outer garment to cover and contain the tummy of the wearer when the outer garment is closed properly at its fastening apparatus.

REFERENCE KEY FOR DRAWINGS

Due to the relatively numerous components and structures of the present invention, and for greater illustrative guidance, a reference key is included in connection with the drawings. With regard to these reference numbers and the letter M used in this document, the following numbering system is used throughout the drawings.

Phantom model M
Jeans garment 10
Front panels 10*a*
Rear panels 10*b*
Rear panel yoke 10*y*
Waistband 10*c*
Fly and zipper closure system 10*d*
Fifth pocket 10*e*
Front aperture for pockets 10*f*
Rear patch pocket with logo 10*g*
Logo patch 10*h*
Belt loop 10*i*
Buttocks enhancing contoured form system 11
Tapered open-cell foam pad 11*a*
Laterally stretchable and resilient posterior casing 11*b*
Anterior lining 11*c*
End crotch portion 11*d*
Center structure sewing line 11*e*
Outer edge structure sewing line 11*f*
Free floating edge of anterior lining 11*g*
Single layer diamond shaped expandable structure 11*h*
Inner structure sewing line 11*i*
Anterior lining bottom edge 11*j*
Anterior lining yoke 11*y*
Foam form concave space 0
The tummy slimming and smoothing pocket system 12
Bottom edge of pocket system 12*a*
Side sewing portion 13
Inner seam sewing portion 14
Sewing portion of the fly and zipper closure system 15
Waistband sewing portion 16
Rear center sewing portion 17
Front center sewing portion 18
Hem sewing portion 19
Phantom line 20

BRIEF DESCRIPTION OF THE DRAWINGS

In addition to the pertinent objective and features of the present invention mentioned in the summary of the invention, the following detailed description of the preferred embodiments of the invention will be better understood when reviewed in conjunction with the associated figures and drawings. These drawings and figures are included for purposes of examples relative to the instant invention, and not in any manner or form for purposes of placing limitations with regard to what is claimed under the present invention.

DETAILED DESCRIPTION OF THE PREFERRED EMBODIMENTS

The present invention will now be described and discussed in a more comprehensive manner with references to the accompanying schematic and descriptive drawings, as the preferred embodiments of the present invention are illustrated. FIGS. 1 through 7 and the narrative that follows details the exemplary embodiments and the construction of the present invention employing a consistent numbering pattern to refer to specific and similar elements throughout the schematic illustrations. The referenced numbers, identified in the preceding "Referenced Number Key" denotes identical and interchangeable requisites of the embodiments of the present invention and sometimes are utilized in lieu of detailed descriptions where appropriate.

It must be understood that, in addition to the specific illustrations herein, the preferred embodiments may be incorporated in jeans made of denim and various fabrics, to include skinny jeans, straight leg jeans, flared leg jeans, baggy jeans, and other pants garments, as well as other garments and, as such, should not be construed as limited to the schematic illustrations set forth herein. Fundamentally, these embodiments are provided in order that this disclosure will be comprehensive and thorough, with full conveyance of the scope of the invention to people skilled in the art and trade of clothing manufacturing.

Figure 1:
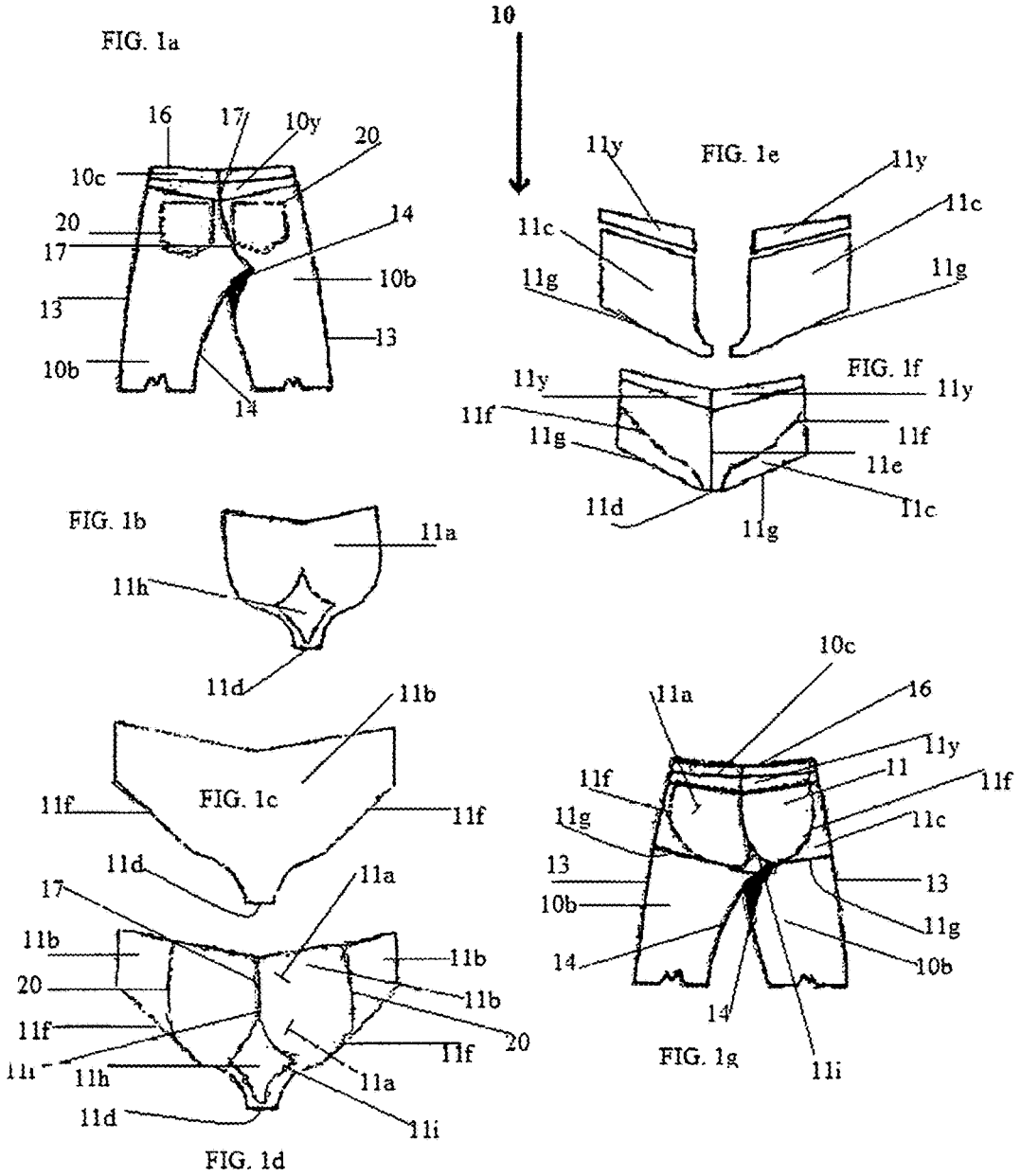
FIG. 1 is a grouping perspective view of the inner construction components of the posterior or rear portion of a jeans garment having body contouring and shape-enhancing functions according to an embodiment of the present invention.

FIG. 1 is a collective grouping of a subset of figures labeled FIG. 1*a* through FIG. 1*g* and details the most crucial embodiments of the present invention as depicted in jeans garment 10. This sequential illustration provides a perspective view of the components and construction of the inner posterior of jeans garment 10.

FIG. 1*a* represents the coupled interior of rear panels 10*b*, rear yoke portions 10*y*, the rear portion of waistband 10*c*, the side sewing portions 13, inner seam sewing portion 14, waistband sewing portion 16, rear center sewing seam 17 and, exterior patch pocket placement shown as phantom line 20.

The subsequent illustrations, FIGS. 1*b*, 1*c*, 1*d*, 1*e*, and 1*f* constitutes central embodiments of the present invention which forms the buttocks enhancing contoured form system 11, and represents the integral interior posterior structure of jeans garment 10.

An embodiment of the present invention, FIG. 1*b*, represents the contoured open-cell foam pad 11*a*, consisting of a concave side and a convex side, respectively fashioned to represent the natural shape of a female's buttocks with an opening 11*h* emanating at the approximate standard region which corresponds to a similar point on the wearer's buttocks where the right and left buttocks cheeks separate and extending to end crotch portion 11*d*. This embodiment of the present invention forms the single layered, expandable and retractable diamond shaped structure 11*h*, which extends downward and outward towards the bottom of the open cell foam pad and allows for simulation of the natural separation of the right and the left buttocks hemispheres and is enhanced by the intentional tapering of the open cell pad 11*a* from the highpoint of the center of each buttock check to a single layer at the outer ends of 11*a* when encased with 11*b*, as shown in FIG. 1*c*.

Another aspect of an embodiment of the present invention, jeans garment 10, the buttocks enhancing contoured form system 11 is shown in FIG. 1*d*, and is comprised of the open cell foam pad 11*a*, and a posterior casing which consists of a laterally stretchable material 11*b* and is bound to the convex side of the open cell foam pad 11*a*.

As shown in FIG. 1*d*, the central embodiment 11, the structured single layer diamond shaped expandable lower posterior section 11*h*, is formed when 11*a* and 11*b* are bound by and at the inner structure sewing line 11*i* which extends to the end crotch portion 11*d*. Further, 11*a* and 11*b* are bound by and at the outer edge structure sewing lines 11*f* and the end crotch portion 11*d*.

This embodiment of the contoured, convex and concave shaped, tapered open cell foam pad 11*a* and the laterally stretchable posterior casing 11*b* is herein after referred to as 11. When 11 is integrally sewn with additional embodiments of the present invention, which are later described in this narrative, it provides for an invisible transition from the pad to the casing and is undetectable when worn. Further, the embodiments of 11, eliminates the uni-butt phenomenon, or similar unnatural presentations by allowing for the representation of the natural separation of both hemispheres of the right and left buttocks when 11 is integrally sewn with additional embodiments of the present invention, jeans garment 10, as previously noted and illustrated in FIGS. 1*e* and 1*f*.

Another embodiment of the present invention, the anterior lining, comprises of a right and left panel, and right and left yoke portions, comprised of minimally stretchable materials shown separately in FIG. 1*e*, and are shown collectively in FIG. 1*f* and is herein after identified as 11*c*, the anterior lining. This anterior lining 11*c* is then coupled to the bottom edge of 11 by and at the outer edge structure sewing line 11*f*, at the end crotch portion 11*d*, and at the upper mid-center by 11*e*, the center structure sewing line.

Subsequently, rear portions of the jeans garment 10, as shown in FIG. 1*a* are coupled together with 11 and 11*e* by sewing at pertinent and similar sections to include the side sewing portions 13, the inner seam sewing portions 14, and the waistband sewing portions 16. This integration provides stability of the buttocks enhancing contoured form system 11, and eliminates unsightly and uneven shifting and sagging when the jeans garment 10 is worn. Of particular note, the free floating edge 11*g* of anterior lining 11 is centrally affixed at the inner seam sewing portion 14 at its lower midpoint 11*d*, its end crotch portion. This free floating edge of the anterior lining, 11*g*, is not sewn or affixed to any additional portions of the jeans garment, 10, other than at the outer most sewing portions of 13. This utility, when coupled with additional embodiments of the present invention, permits conformance to the natural contours of the hips and buttocks of the wearer in a free and non-restrictive or binding manner, hence providing comfort with ease of wearing and freedom of movement.

Figure 2:
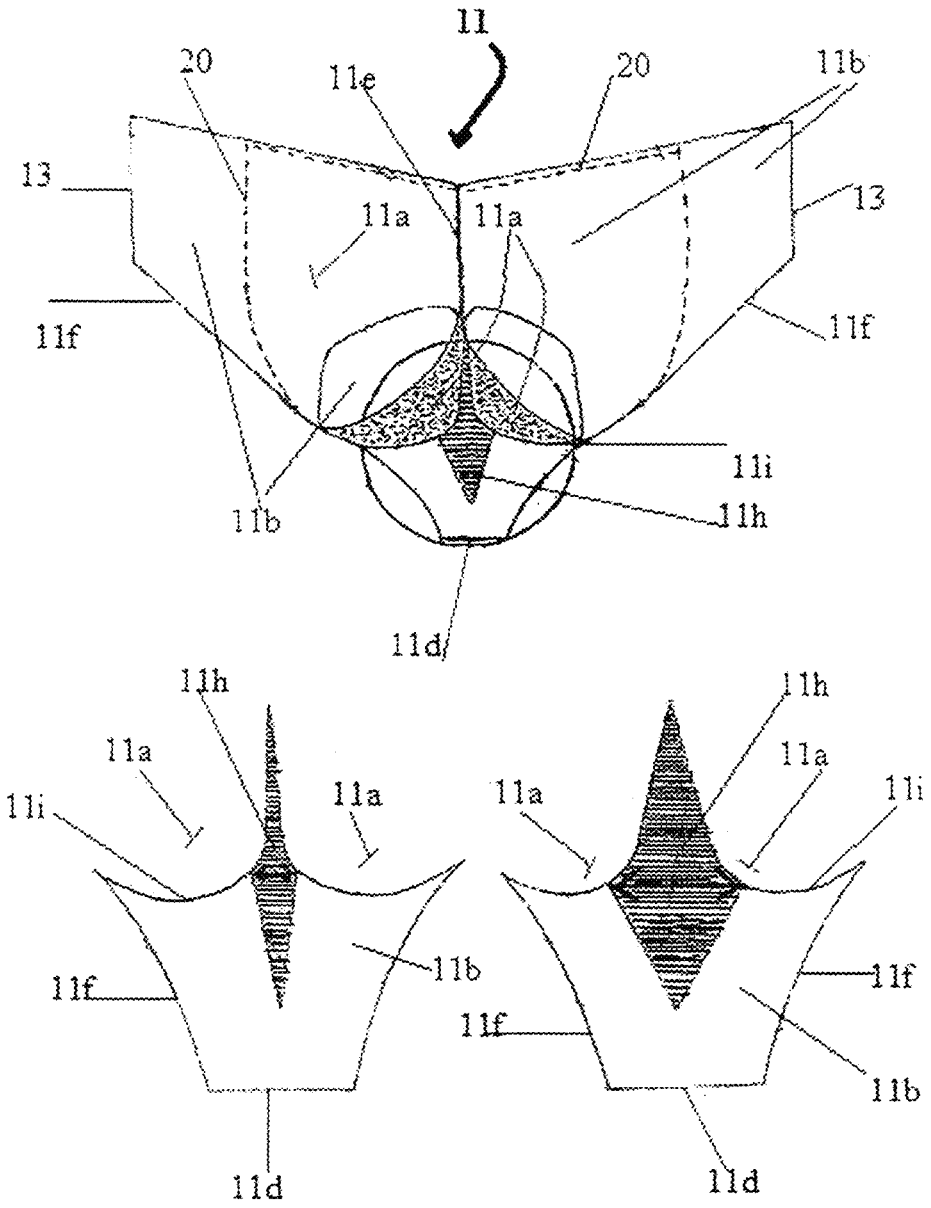
FIG. 2 is a perspective view of the inner structure portion, which comprises of the buttocks enhancing contoured foam form system according to an embodiment of the present invention, having body contouring and shape enhancing functions.

FIG. 2 provides a detailed illustration of the most essential aspect of the present invention 10 by depicting a sectional perspective view of the composition of the buttocks enhancing contouring form system 11, and delineates the functioning of the single layer diamond shaped expandable structure 11*h*. The upper most drawing shows the tapered open cell foam pad 11*a*, with the encircling of the prominent features further expanded in the two section diagrams below. Additionally, this demonstrates an embodiment of 11, which affords the lateral expansion and retraction of 11*h* depending on, and varying with the shape and movement of the wearer in a non constricting manner and is directly attributable to the composition of 11*b*.

The lower left diagram illustrates 11*h* of this embodiment in a closed position, which would likely be demonstrated when the wearer is in an upright, closed leg position or when the present invention 10 is not in use. The lower right diagram illustrates the 11*h* embodiment of the present invention 10, in use by the wearer when engaging in movement.

Of note, the degree of expansion of this aspect of 11, specifically 11*h* will vary according to the wearer's individual size and physique, as well as the wearer's movement and positioning when wearing the present invention, jeans garment 10.

FIG. 2 further demonstrates the tapered open cell foam pad 11*a* as revealed at the peeled back location of the posterior casing 11*b*, as shown in the encircled section of the upper thawing of FIG. 2. The central points of integration of 11*a* and 11*b*, as previously described with the binding of 11*a* and 11*b* by and at the inner structure sewing line 11*i*, which emanates at the approximate standard region corresponding to a similar point of the wearer's buttocks natural separation forming the right and left buttocks' cheeks, to the end crotch portion, as best denoted by 11*d*. Further, as previously described 11*a* and 11*b* are bound by and at the outer bottom edge of 11*a* forming the outer edge sewing structure line 11*f*. And as further described in the preceding narrative, 11 and 11*c* are subsequently integrated to the posterior and rear of jeans garment 10 by sewing at pertinent and similar sections to include the side sewing portions 13, the inner seam sewing portions 14, and the waistband sewing portions 16 as depicted in FIG. 1*g*.

Figure 3:
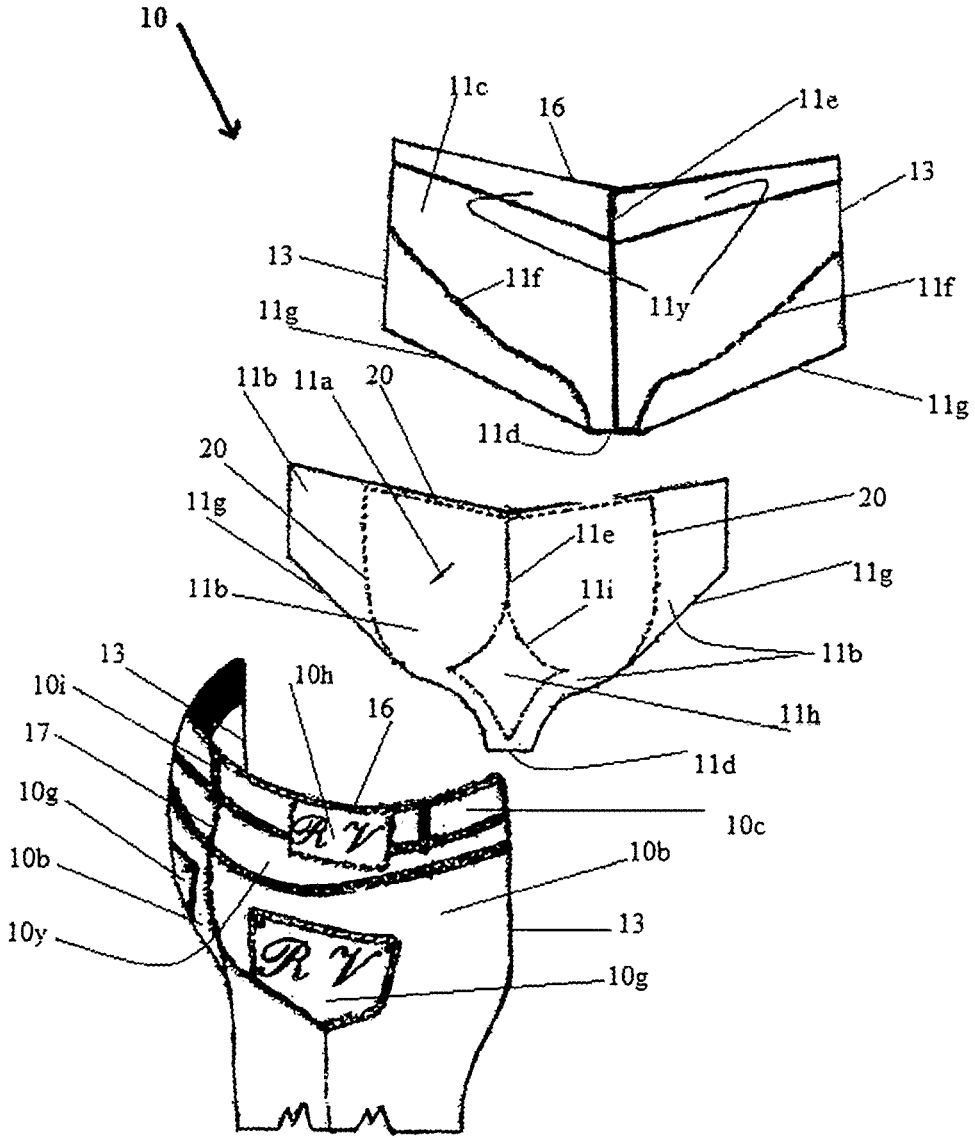
FIG. 3 is an exploded perspective view of the placement of the inner structure components of the buttocks enhancing contoured form system that is an integral part of a jeans garment having body contouring and shape-enhancing functions according to an embodiment of the present invention.
Figure 7:
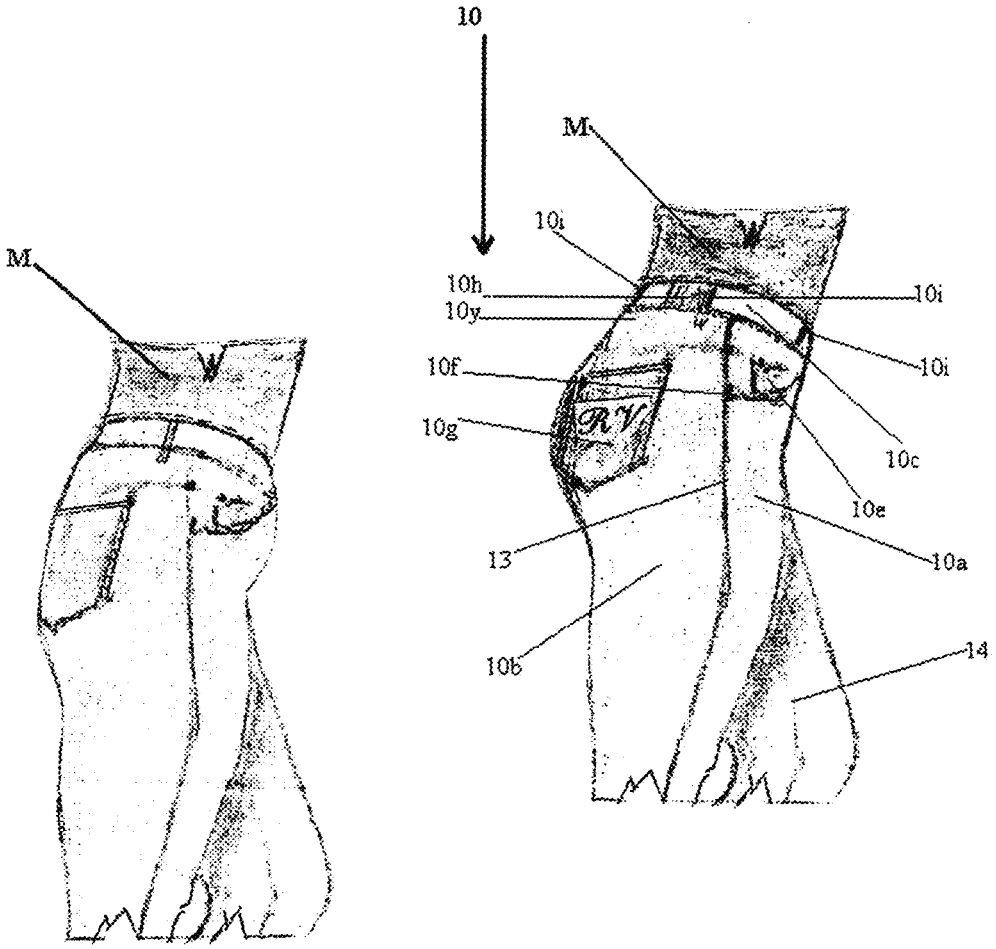
FIG. 7 is a comparative perspective view of a phantom model wearing a conventional pair of jeans without the benefit of shape enhancing apparatus, and the same phantom model wearing a jeans garment having body contouring and shape-enhancing functions according to embodiments of the present invention.

FIG. 3, is an the exploded perspective view detailing the placement and coupling of an embodiment of the posterior of the inner structures of the present invention 10, the contoured form system 11, with the anterior lining 11*c* and the rear posterior elements of the jeans garment 10, including the rear panels 10*b*, rear yoke portions 10*y*, and the rear portion of waistband 10*c*. These components of the present invention are subsequently incorporated into the jeans garment 10, at the side sewing portions 13, the inner seam sewing portions 14, and the waistband sewing portions 16. This integration provides stability of the buttocks enhancing contoured form system 11, and eliminates unsightly and uneven shifting and sagging when the jeans garment 10 is worn and provides the tangible and aesthetic enhancement of the wearer as shown in FIG. 7.

Further, an additional embodiment of the present invention, specifically the 11*h*, the single layer diamond shaped expandable structure portion of 11, when incorporated as shown in FIG. 3, eliminates the uni-butt phenomenon, or similar unnatural presentations as seen by other inventions, by allowing for the representation the natural separation of both hemispheres of the right and left buttocks of the wearer in a free and non-restrictive or binding manner, hence providing comfort with ease of wearing and freedom of movement.

The free floating edge 11*g* of anterior lining 11, is centrally affixed at the inner seam sewing portion 14, with its end crotch portion 11*d*, but is not sewn or affixed to any additional portions of the jeans garment, 10, other than at the outer most sewing portions of 13. This mode of integration of inner and outer structures provides stability of the buttocks enhancing contoured form system 11, and eliminates unsightly and uneven shifting and sagging when the jeans garment 10 is worn. This utility, when coupled with additional embodiments of the present invention, particularly the underlying contoured concave and convex aspects of 11, permits conformance to natural contours of the hips and buttocks of the wearer in a free and non-restrictive or binding manner, hence providing comfort with ease of wearing and freedom of movement. Unlike other inventions, embodiments of the present invention 10, enhances, supports and conforms to the wearer's buttocks and hips regardless of the wearer's underlying physique; providing comfort, ease of movement and confidence in an improved appearance.

Figure 4:
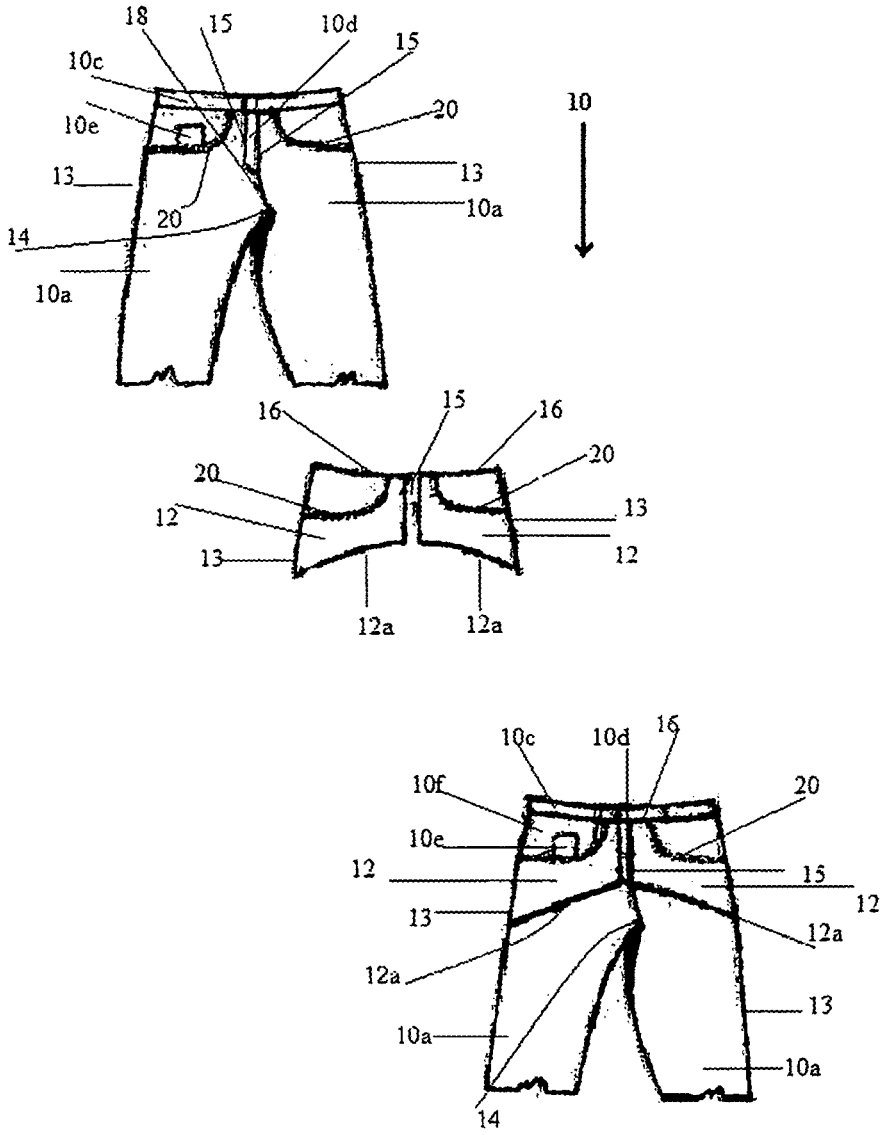
FIG. 4 is a perspective schematic view of the inner construction and placement of a pocket system having tummy smoothing and slimming functions according to an embodiment of the present invention.

FIG. 4 details the construction and placement of the tummy slimming and smoothing pocket system 12, which is constructed from a similar minimal stretch fabric to that of the anterior lining 11*c*. Specifically, the perspective schematics of FIG. 4 in the left upper illustration shows the interior of the front panels 10*a*, of the present invention, jeans garment 10, without the benefit of this stated embodiment 12. This illustration reveals the right and the left front panels 10*a* joined at the front center sewing portion 18; the placement of a fastening system represented by the sewing portion of the fly and zipper closure system 15; the front section of waistband 10*c*; and phantom lines 20 which represent placement of a fifth pocket 10*e*, as well as the left and right front pocket apertures 10*f* for indicating exterior integration of 12.

Another embodiment of the present invention, jeans garment 10, is depicted in the middle illustration and shows the right and the left frontal tummy slimming and smoothing pocket system 12 individually. Also noted in this illustration are the phantom lines 20 indicating exterior frontal pocket apertures 10*f*; lower edge of the right and left pocket system 12*a*; the side sewing portions 13; the fly and zipper closure sewing portions 15; and waistband sewing portions 16.

The lower illustration shows the interior of the jeans garment 10, with the embodiment of 12 fully integrated and strategically designed and positioned to cover the tummy of the wearer so as to provide support and containment of any preexisting tummy protrusion. The tummy slimming and smoothing action of the preferred embodiment 12 is accomplished due to the specifically fashioned enlarged and slanted pocket system 12, which is not utilized in conventional jean garments or noted in prior art. The placement of the pocket system 12 is integrated into the jeans garment 10, by sewing when coupled to the right and left front panels 10*a* at the right and left frontal waistband sewing portions 16; the right and left of the fly and zipper closure system 10*d* at right and left of the sewing portion of the fly and zipper closure system 15; and at the right and left of the side sewing portions 13; and further integrated into the jeans garment 10, at the right and left front panels 10*a* through attachment to the front apertures 10*f*, and fifth pocket 10*e* as noted by the respective placement of phantom lines 20, and further detailed in FIGS. 5, 6 and 7. This method of integration provides for a natural slimming and smoothing action when the present invention 10 is secured on the wearer by the closure of the fly and zipper closure system 10*d*.

The abdomen of the wearer is gently contained with the closure of 10*d*, due to full coverage of the abdomen provided for by the enlarged, minimal stretch pocket system 12, which creates the slimming and smoothing action of the present invention, the jeans garment 10. Further, the abdomen of the wearer is not constricted. Therefore, the often upward protrusion of the abdomen which creates the "muffin-top" effect, as with constricting garments such as girdles, is not seen, and therefore, the wearer is not compelled to an uncomfortable and unnatural presentation in the effort to aesthetically improve one's outer appearance.

This utility achievement according to the embodiments of the present invention is further depicted in FIG. 7 with the schematic perspective illustration of the improved appearance of phantom model M from the view of M without and the view of M with the application of the jeans garment 10.

Figure 5:
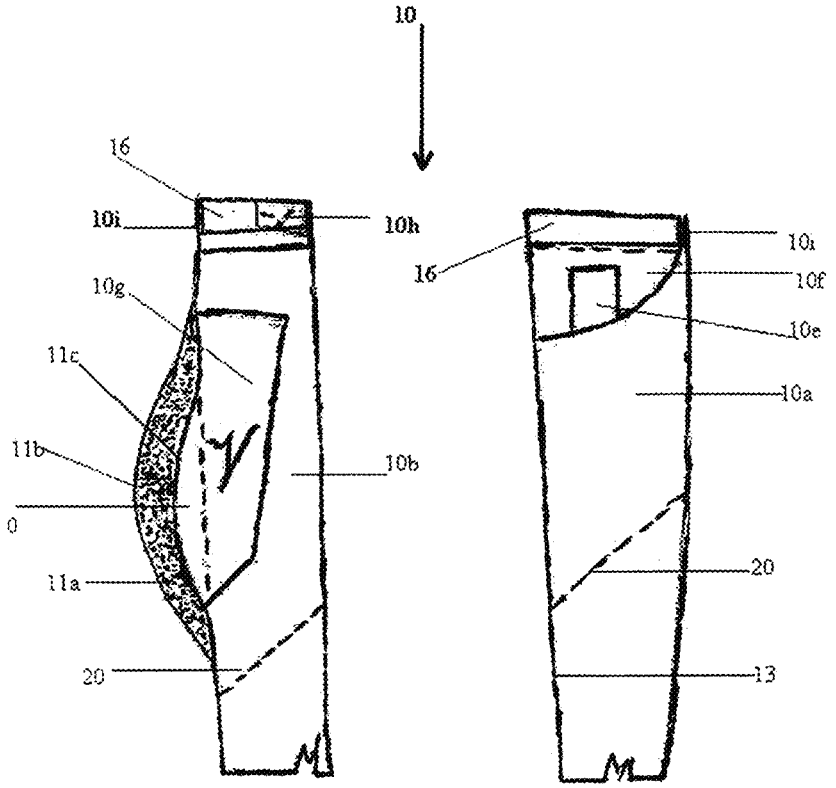
FIG. 5 is a perspective side elevational view of a cut-away schematic of the anterior and posterior torso portion of a jeans garment having body contouring and shape-enhancing functions, according to embodiments of the present invention, and as depicted in FIGS. 3 and 4.

FIG. 5 depicts a cut-away section which includes the right side elevational perspective view of the rear panel 10*b*, and the right side elevational perspective view of the front panel 10*a* of the jeans garment 10. The cut-away perspective views provide a vivid illustration and schematic drawing of the unique components, construction and placement of the buttocks form system 11, thereby demonstrating the mechanics of the enhancing and contouring embodiments of the present invention 10. The positioning of 11 as described in the preceding detailed narrative of FIG. 2 provides for the individualized acceptance, placement and positioning of the wearer's buttocks within the concave spaces 0, which is supported by the flexible and resilient composition of 11. The unique fashioning of the single layer, diamond shaped expandable structure 11*h*, along with the right and the left concave spaces 0, allows 11 to hug and conform to the wearer's posterior lower torso region, and whereby the convex portions of 11*a* aesthetically lifts and shapes the buttocks. Additionally, depicted in FIG. 5 is the right anterior and frontal coupling of 12 to the front aperture 10*f*, and fifth pocket 10*c*, with a phantom line 20 indicating the bottom edges of the pocket system 12*a* at the interior of the jeans garment 10, when affixed at 10*a*.

Figure 6:
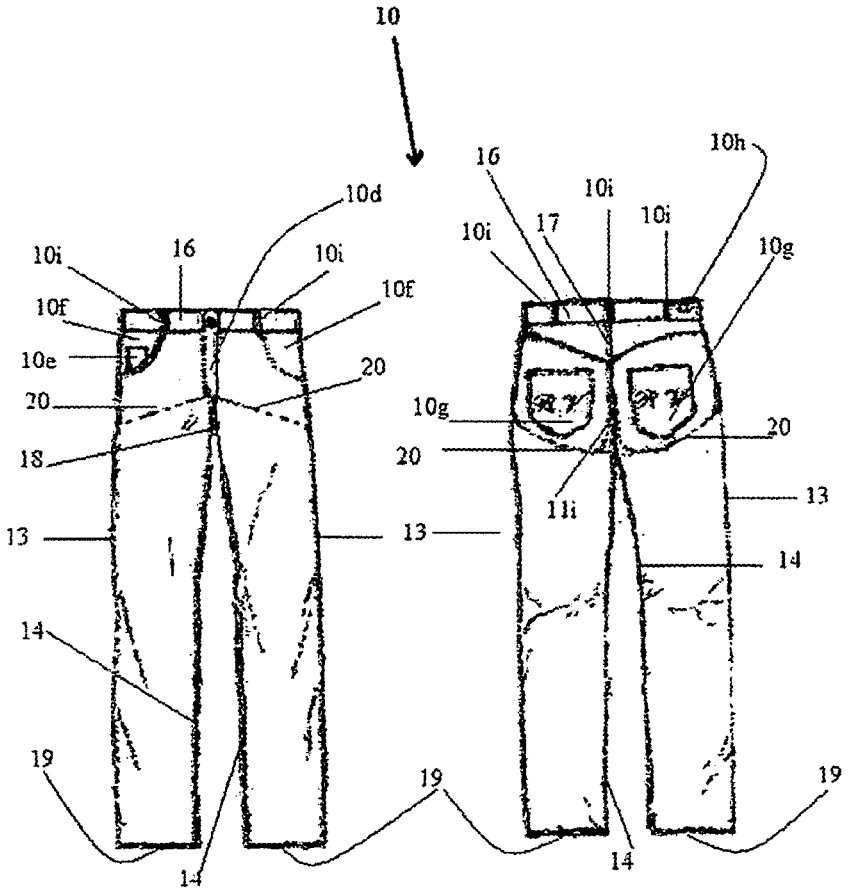
FIG. 6 is an exterior frontal view and an exterior rear perspective view of a jeans garment having body contouring and shape-enhancing functions according to embodiments of the present invention.

FIG. 6 illustrates the frontal perspective and rear posterior perspective views of the jeans garment invention 10, respectively. The opposing phantom lines 20, depicted at the front panels of 10 represents the bottom edges 12*a* of the tummy slimming and smoothing pocket system 12 located in the interior of the right and left front panels 10*a* of the jeans garment 10. Similarly, the phantom lines 20 illustrated in the right drawing of FIG. 6 indicates the right and left free floating edges 11*g* of the anterior lining 11*c* in the interior of the right and left rear panels 10*b*. Similarly, the inner structure sewing line 11*i* is depicted in this right schematic illustration and is indicated on the outer rear posterior of the present invention 10 by a broken line so noted. As such, this broken line indicates the placement of 11, and more specifically the positioning of the single layer diamond shaped structure 11*h*, although 11*h* is not visible with the legs of the jeans garment in the closed position.

FIG. 6 further depicts the front and back outer perspective views of the completed present invention, the jeans garment 10 and illustrates the outer components of said garment, including the waistband 10*c* which is attached to the front panels 10*a* and the rear panels 10*b* at the sewing portion 16 and surrounds the waistline of the wearer. Also illustrated are the placement of the belt loops 10*i*, the right and left front aperture 10*f*, the fifth/coin pocket 10*e*, the fly and zipper closer system 10*d* in the closed position, front center seam 18 joining the front left and front right panels midline immediately below 10*d* to the center top crotch junction of 14, rear center seam 17 which extends from the 16 at the top portion to 14 at the end portion, rear patch pockets 10*g* located on the right and left rear panels 10*b*, the logo patch 10*h*, and a hem line 19 located at the lower aperture of the right and left, front and rear panels coupled at the sewing lines 13 of 10*a* and 10*b*, respectively.

The left illustration of FIG. 7 depicts a right side elevational view showing the usual and customary appearance of the phantom model M when wearing a traditional jeans garment and without the benefit of embodiments of the present invention, jeans garment 10. The right illustration of FIG. 7 demonstrates the transformation of the phantom model M when M is wearing the present invention consisting of the jeans garment 10 with all of the embodiments of the present invention as detailed throughout this narrative.

FIG. 7 best depicts the finished jeans garment 10 with the preferred embodiments, the buttocks enhancing contoured form system 11, and the tummy slimming and smoothing pocket placement system 12 as shown in the exploded schematic illustration in FIG. 3.

The present invention has been comprehensively described with specific diagrams and illustrations, coupled with a detailed narrative of its embodiments that the process of manufacture will be readily understood by those of ordinary skills in the art. In addition, modifications may be made to allow for a particular feature or alternative fabric, such as corduroy or woolen materials to the teaching of this instant invention without departing from the scope thereof.

As such, following the description of the present invention, what is claimed as new and desire to secure by Letters Patent is:

1. A jeans garment having body contouring and shape-enhancing functions comprising: a jeans garment having two front panels and two rear panels, with yoke portions joined by right and left side seams, with an interior component with an inner seam that extends from a vertical crotch seam of the jeans garment and attaches a lined free floating contoured foam interior component to the yoke portion of the jeans garment formed of 3×1 right-hand twill exterior denim material; a rear posterior center seam, a front center seam with a fixed closure device, including a zipper or button construction, along with a waist portion at upper segments of seat portions in the two rear panels that are configured to encircle the waist of a wearer to which a waistband with belt loops are affixed; and a buttocks shape-enhancing interior contoured and lined foam component is permanently affixed to the inner structure of the yoke at a posterior of the waist portion of the jeans garment, and the buttocks shape-enhancing contoured form device consists of:

an open cell foam pad which is contoured in a concave, convex and tapered manner, encased in laterally stretchable elastic fabric to comprise the interior component of the seat portion and is fashioned in a vertical plane so as to simulate the right and left buttocks cheeks of the wearer, with a single layer expandable and retractable diamond shaped portion positioned at a center lower section of the lining encased foam pad to accept and shape the wearer's buttocks;

and an anterior lining made from minimally stretchable material and fashioned as a shape enhancing interior component of the jeans garment with a free floating edge which when coupled to the aforementioned contoured foam pad in the jeans garment, permits the free and non-restrictive movement and enhancement as being configured to the natural contours of the hips and buttocks of the wearer of the jeans garment; and a tummy slimming and smoothing pocket device which is constructed from minimally stretchable fabric and is fashioned in an oversized and angled manner wherein each smoothing pocket device is attached in a barrack manner extending the full vertical length of the zipper/button fixed closure device, beginning at the lower sewing of the waistband and a pocket with similar barrack stitching of the tummy slimming and smoothing devices at the front pocket openings, wherein this tummy slimming and smoothing component is permanently affixed to the interior portion of the denim fabric at the front panels of the jeans garment and is configured to cover and contain any undesirable or excessive abdominal protrusion of the wearer when the jeans garment is closed at its front zipper/button fastening system.

2. The jeans garment having body contouring and shape-enhancing functions of claim 1, wherein the jeans garment affixed buttocks open cell foam pad component system of, simulated symmetrical concave regions, as viewed from a posterior perspective on the wearer, creates an appearance of two natural buttocks cheeks, when constructed as one continuous multi-layered unit.

3. The jeans garment having body contouring and shape-enhancing functions of claim 1, wherein the laterally stretchable and resilient posterior casing within the seat portion of the jeans garment has an expandable vertical length, and is configured to accommodate the natural curvature of the wearer within the shape enhancing device, within the seat portion of the jeans garment.

4. The jeans garment having body contouring and shape-enhancing functions of claim 1, wherein the single layer diamond shaped vertically and horizontally expandable structure has an expandable vertical length greater than its allowed expandable horizontal width.

5. The jeans garment having body contouring and shape-enhancing functions of claim 1, wherein the jeans garment interior surface of the buttocks enhancing contoured form system component has an expandable concave internal surface, that is configured to accommodate various wearers buttocks sizes within a plus two or minus two sizes in typical industry measured dimensions.

6. The jeans garment having body contouring and shape-enhancing functions of claim 1, wherein the jeans garment is designed and constructed to provide to enhance the appearance of the jeans garment wearer, where the tapered open-cell foam pad, having a free floating configuration with single layered diamond shaped multi directional stretch center structure, its optionally comprised of any one of an elastic gel silicone or open-cell foam pad, to thereby lift, expand and improve a directional arrangement of the buttocks and abdominal region of the wearer.

7. The jeans garment having body contouring and shape-enhancing functions of claim 6, wherein the multi-layered contoured interior component in the seat portion of the jeans garment is of a uniform vertical and horizontal dimension, that is configured for exchanging an open-cell foam pad for a silicone gel pad without altering the fit or comfort zone of the wearer of the jeans garment.

8. The jeans garment having body contouring and shape-enhancing functions of claim 6, wherein an application of the single layered diamond shaped multi directional and highly stretchable center structure of a lower portion of the free floating laterally expandable posterior section of the tapered shape enhancing contoured form system allows laterally outward movement in conformity with the wearer's up and down movements, while the anterior lining, due to the minimally stretchable fabric component of the front slimming system stays relatively uniform regardless of body movement.

9. The jeans garment having body contouring and shape-enhancing functions of claim 1, wherein, the single layer diamond shape expandable structure expands and contracts laterally in conformity with the lower body movement of the wearer.

10. The jeans garment having body contouring and shape-enhancing functions of claim 9, wherein the buttocks enhancing contoured component in the seat portion of the garment, with stretchable posterior casing, is configured to yield the buttocks cheeks separation conformance technology, which is further enhanced by the posterior centered single layer diamond shape expandable structure.

11. The jeans garment having body contouring and shape-enhancing functions of claim 1, wherein the single layer diamond shaped multi directional center structure of the contoured form system in the garment seat portion, with its free floating edge lined encasement is a centerpiece of the anatomy conformance enhancement technology, which is further enhanced through the application of stretchable fabrics in the seat portion of the jeans garment, coupled with stretch stitching utility applications.

12. The jeans garment having body contouring and shape-enhancing functions of claim 1, wherein the buttocks enhancing contoured form system in the seat portion of the jeans garment is formed from a single mold of open cell foam or silicone gel with a vertical separation beginning approximately 3-4 inches from a bottom edge of the jeans garment waistband, resulting in a vertically elongated diamond shape structured separation, with a horizontal measurement that is just a fraction of the diamond shaped center structure vertical dimension, and with this structured diamond shape apparatus, allowing for the simulated buttocks, which develops the distinctive buttocks cheeks movement while maintaining full integration with a stretchable and breathable posterior casing and anterior portion cotton lining, which sandwiches the single mold while the stretchable diamond shaped center structure allows for the natural movement of the wearer of the jeans garment buttocks.

* * * * *